US005797193A

United States Patent [19]

Amend et al.

[11] Patent Number: 5,797,193

[45] Date of Patent: Aug. 25, 1998

[54] ALIGNMENT APPARATUS FOR LITHOGRAPHIC SYSTEM

[75] Inventors: Richard E. Amend; William A. Hartlove, both of Baltimore, Md.

[73] Assignee: U.S. Can Metal Services, Oak Brook, Ill.

[21] Appl. No.: 668,999

[22] Filed: Jun. 24, 1996

Related U.S. Application Data

[63] Continuation of Ser. No. 635,333, Apr. 19, 1996, abandoned.

[51] Int. Cl.[6] ..... B41B 11/00

[52] U.S. Cl. ..... 33/614; 33/617; 33/645

[58] Field of Search ..... 33/614, 427, 430, 33/464, 483, 848, 485, 533, 613, 617, 618, 644, 645

[56] References Cited

U.S. PATENT DOCUMENTS

| | | | |
|---|---|---|---|
| 1,153,896 | 9/1915 | Dittrich . | |
| 1,431,293 | 10/1922 | Dittrich . | |
| 1,553,001 | 9/1925 | Nary et al. . | |
| 2,339,467 | 1/1944 | Eckhard et al. . | |
| 2,621,411 | 12/1952 | Christen . | |
| 3,330,210 | 7/1967 | Hobbs et al. . | |
| 3,371,423 | 3/1968 | Paul | 33/464 |
| 5,038,486 | 8/1991 | Ducate, Sr. | 33/430 |
| 5,155,921 | 10/1992 | Banike | 33/618 |
| 5,255,607 | 10/1993 | Nishiyama et al. | 33/617 |

FOREIGN PATENT DOCUMENTS

| | | | |
|---|---|---|---|
| 1312955 | 11/1962 | France | 33/614 |

*Primary Examiner*—Christopher W. Fulton
*Attorney, Agent, or Firm*—Leydig, Voit & Mayer, Ltd.

[57] ABSTRACT

An apparatus is provided for configuring a printing station of a lithographic system to align a workpiece with a printing cylinder of the printing station. The apparatus includes an elongated body attached in a predetermined fashion to a platform which supports a workpiece disposed for delivery to a printing cylinder. Two cross-arms are spaced apart and attached to the body member. The first cross-arm comprises two half-portions, each of which is adapted for adjustable lateral extension. The second cross-arm is knight attached to the elongated body, and disposed for adjustable positioning along the body in relation to the first cross-arm.

22 Claims, 3 Drawing Sheets

ALIGNMENT APPARATUS FOR LITHOGRAPHIC SYSTEM

RELATED APPLICATIONS

This application is a continuation of application Ser. No. 08/635,333, filed Apr. 19, 1996 now abandoned.

BACKGROUND OF THE INVENTION

1. Field of the Art

The present invention generally relates to lithographic systems, and more particularly, to apparatus for aligning a workpiece with a printing cylinder of a lithographic system.

2. Discussion of the Related Art

At a printing station of a lithographic system, a visual image is transferred onto a workpiece, such as a piece of sheet metal. A typical printing station includes a roller or drum, also known as the printing cylinder, which has a printing plate wrapped around its outer periphery. Impressioned upon the face of the printing plate is the visual image that is to be transferred to the workpiece during the lithographic process.

Image transfer from the printing plate to the workpiece is achieved by colorizing the face of the printing plate (using ink and the like), aligning the workpiece with the printing cylinder, synchronizing the feed of the workpiece with the printing cylinder, then advancing the workpiece into the printing cylinder. Once the workpiece comes into pressure contact with the printing cylinder, the rotary movement of the printing cylinder acts, in part, to propel the workpiece through the printing station. At the same time, the ink or other colorizing material on the face of the printing cylinder is transferred to the surface of the workpiece. More particularly, the visual image impressed upon the face of the printing plate, is transferred to the workpiece.

The aforementioned process is well known and understood in the field of lithographic printing. Also appreciated in this field is the need for precise registry of the workpiece with the printing cylinder. To be sure, precise alignment, both lateral (transverse) and longitudinal, between the workpiece and the printing cylinder must be insured.

Lateral alignment is provided in part by guide rollers adjustably disposed near the face of the printing cylinder. Indeed, the guide rollers are configured to have a laterally adjustably disposition, whereby they are preadjusted to both align the workpiece with the printing cylinder, and also to maintain modest contact between the guide rollers and the edge of the workpiece. This opposing contact applied by the guide rollers against the workpiece helps sustain the lateral alignment as the workpiece is advanced into the printing cylinder.

Longitudinal alignment of the workpiece is provided by proper synchronization of the printing cylinder with a feed mechanism that advances the workpiece into the printing cylinder. This synchronization is achieved by the coordination of rear pushers with the revolution of the printing cylinder. Typically, the rear pushers are attached to an endless chain that is driven in conjunction with the printing cylinder, thereby maintaining synchronization between the rear pushers and the printing cylinder. Initial adjustments are made to configure the rear pushers to a given workpiece by controllably disposing the printing cylinder to a particular orientation, then adjusting the rear pushers to a predetermined distance from the printing cylinder. Thereafter, as the printing cylinder revolves, the rear pushers advance to propel the workpiece into the printing cylinder.

It is appreciated that adjustments to the guide rollers and rear pushers must be made periodically. Once the printing station is set up for a particular stock, or size of workpiece, the printing process will be performed on hundreds, if not thousands, of workpieces. Therefore, the adjustments to the guide rollers and rear pushers need only be made when adapting the printing station to a new workpiece stock or to ensure that the position of the rollers have not moved during the printing process. While the set-up procedure for adjusting guide rollers and rear pushers need only be performed periodically, it is nevertheless important to simplify this procedure in order to minimize the time required and, therefore, maximize efficiency and cost-savings.

Typically, the set-up procedure is achieved by marking and cutting a piece of sheet metal to form the same size stock that is to be printed. Then this piece is positioned at the feed or input side of a printing roller, and the rear pushers and guide rollers are engaged and adjusted to the edges of this sheet. To prevent the sheet from being displaced during this process, it must be tensioned in some fashion, otherwise, the guide rollers and rear pushers will tend to dislocate it from its set-up position. This tensioning may be accomplished by holding the sheet metal down with a high-pressure air flow.

There are, however, several shortcomings to this present approach. For example, this approach requires additional time to precut sheet metal to size each time a newly sized workpiece is to be printed. Another shortcoming relates to center, or lateral, alignment. While longitudinal alignment may be rather easily achieved by abutting the sheet metal against a pair of grippers at the mouth of the printing cylinder, accurate lateral alignment is more difficult, requiring either physical measurements to ensure center alignment, which is time consuming, or "eyeballing" it, which results in alignment inaccuracies.

SUMMARY OF THE INVENTION

Accordingly, it is a primary object of the present invention to provide an apparatus for efficiently aligning workpieces with the printing cylinder of a lithographic system.

Another object of the present invention is to provide an alignment apparatus for a printing station of a lithographic system that is quick and easy to use, providing substantial time savings in the set-up of a printing station.

Still another object of the present invention is to provide an alignment apparatus that is universally sized to work for workpieces of all sizes.

Yet another object of the present invention is to provide an alignment apparatus for a printing cylinder that achieves quick and accurate center alignment.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to an apparatus for aligning a workpiece with a printing cylinder of a lithographic system. An elongated body member, which extends along a path that is transverse to the axis of the printing cylinder, is adapted for alignment with a printing cylinder in a predetermined fashion. A first cross-arm is perpendicularly attached to the body member, and disposed to laterally extend from both sides thereof. In order to facilitate the adjustment of laterally disposed guide rollers of the lithographic system, a first means is associated with the first cross-arm for variably adjusting the lateral extension of both sides of the first cross-arm. A second cross-arm is also perpendicularly attached to the body member, and disposed to laterally extend from both sides thereof. In addition, the second cross-arm is spaced apart from the first cross-arm, and includes second means for variably adjusting the longitudinal spacing separating the first and second cross-arms.

BRIEF DESCRIPTION OF THE DRAWINGS

The accompanying drawings incorporated in and forming a part of the specification, illustrate several aspects of the present invention, and together with the description serves to explain the principles of the invention. In the drawings.

Reference will now be made in detail to various present preferred embodiments of the invention, examples of which are illustrated in the accompanying drawings.

DETAILED DESCRIPTION OF THE PREFERRED EMBODIMENTS

Before describing the apparatus of the present invention, the discussion will first be directed to the environment for which the apparatus of the present invention is intended. Since the structure and operation of the intended environment are understood by persons of ordinary skill in the art, not all of the elements and features described are shown in the figures. Moreover, it should be appreciated that the environmental structure and features described herein are not intended to limit the invention, nor is their description necessary for practicing the present invention, but the description is nonetheless provided for completeness.

Figure 1:
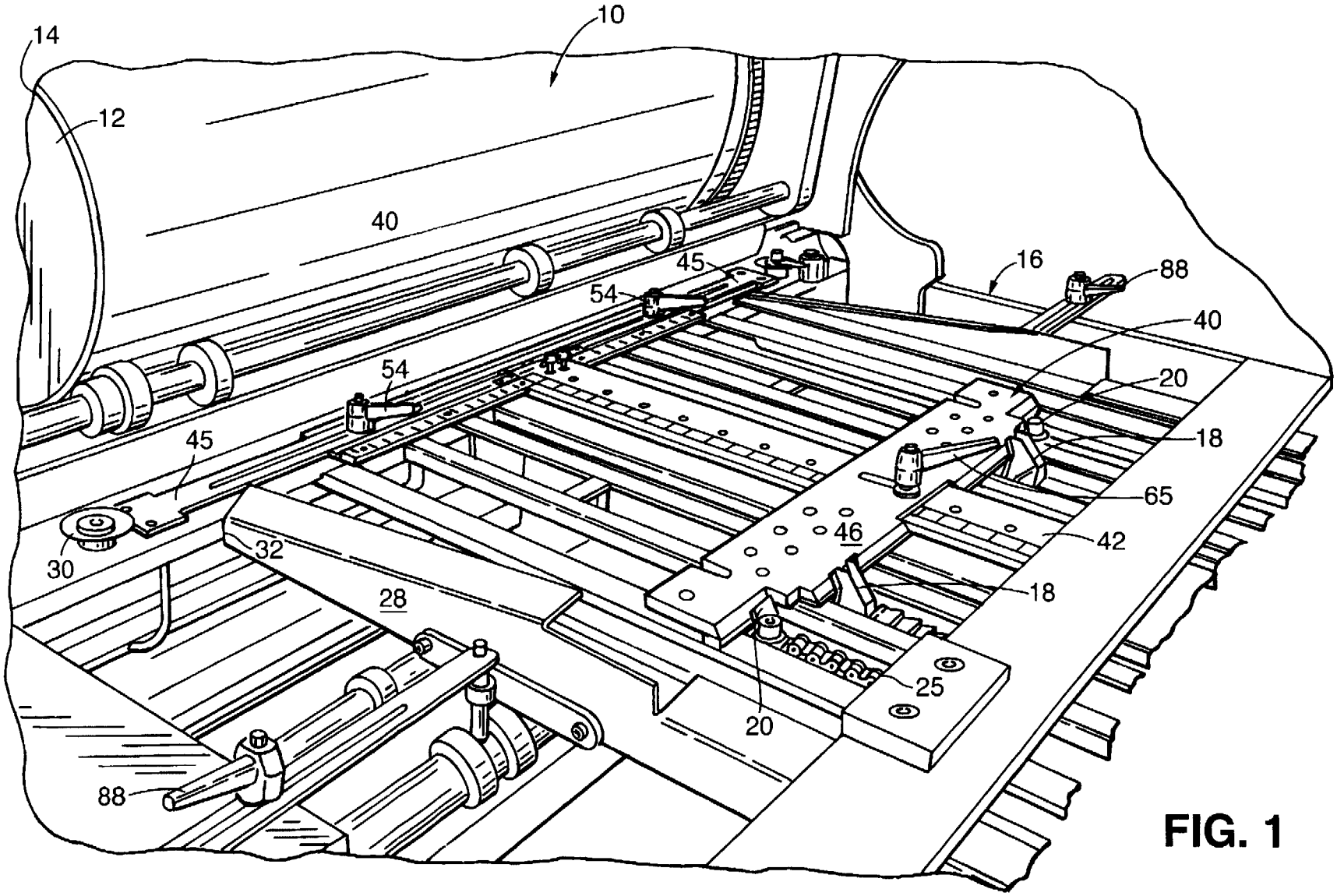
FIG. 1 is a perspective view showing an alignment apparatus in accordance with the present invention, installed at a typical printing station of a lithographic system.

Referring now to the figures, FIG. 1 shows a perspective view of the preferred embodiment of the present invention in its intended environment. More particularly, FIG. 1 shows the input side of a typical printing station in a lithographic system. A printing cylinder 10 is disposed to receive a workpiece (not shown) and transfer a visual image or printing design to the surface of the workpiece. More particularly, the printing cylinder comprises a drum 12 having a printing plate 14 wrapped around the periphery of the drum 12. The printing plate 14 is impressioned with a particular pattern or design that is applied to the surface of the workpiece. Typically, an inking roller adjacent the printing cylinder 10 is adapted to apply ink or some other colorized material to the surface of printing plate 14. As the workpiece travels through the printing station, pressure contact between the printing cylinder 10 and the workpiece act to transfer the color from the printing plate 14 to the surface of the workpiece.

A platform 16 (also referred to as a press bed) supports a workpiece for delivery into the printing cylinder 10. In the illustrated embodiment, the platform 16 comprises a network of steel beams which are arranged to form a level surface for supporting and carrying the workpiece to the printing cylinder 10. The workpiece, such as a piece of sheet metal, is delivered to the platform 16 of the printing station by a conveyer or some other automated means. In the lithographic system of the preferred embodiment, carrier chains having carrier lugs 18 are used to transport or carry a workpiece from a feeder (not shown) to a registration point on the platform 16. As will be described below, the registration point is that location on the platform 16 which serves to align the workpiece with the printing cylinder 10 so that the image impressioned on the printing plate 14 is properly transferred to the surface of the workpiece.

Carrier lugs 18 deliver the workpiece to the platform 16, at which time rear pushers 20 assume control and push the workpiece into its registration point. After the workpiece is aligned in proper registry with the printing cylinder 10, grippers take control of the workpiece to feed it through the printing station. The rear pushers 20 serve to deliver the workpiece to the grippers and hold the workpiece in place with a moderate amount of pressure, until the grippers assume control. This is accomplished by the attachment of rear pushers 20 to a conveyor chain 25. Specifically, rear pushers 20 are attached by a spring to a fixed location on chain 25. When the workpiece is delivered to the registration point, the springs (not shown) attaching rear pushers 20 to conveyor chain 25 are extended, thereby applying a moderate retentive force on the workpiece against the grippers. Advantageously, the spring connection also accommodates minor intolerances in the adjustment of rear pushers 20.

As is known by those skilled in the art, the operation of the grippers is synchronized (via a cam follower) with the cylinder 10 to feed a workpiece into the cylinder 10 at precisely the same point of rotation of each revolution of the cylinder 10. This is significant in multi-color printing applications where the same workpiece must be fed through the cylinder 10 several times.

Guide rails 28 and guide rollers 30 serve to laterally control and guide the workpiece into the registration point. Guide rails 28 are laterally disposed on either side of the workpiece and are initially adjusted to provide a small amount of slack on the sides of the workpiece—e.g., 2 or 3 inches. This provides an initial, approximate alignment as the workpiece is delivered to platform 16 and carried toward the registration point. Furthermore, the slack is preferred so that the workpiece does not bind between the guide rails 28. In addition, the guide rails 28 may be slightly angled so that a smaller space separates the forward end or nose 32 of the guide rail than that which separates the rear end. This serves to funnel the workpiece towards the registration point.

Guide rollers 30 provide the final step of lateral alignment of the workpiece with the printing cylinder 10 at the registration point. As appreciated by those in the art, guide rollers 30 are adjusted to apply a modest inwardly-directed pressure to the workpiece as it arrives at the registration point. In this regard, one of the guide rollers is adjusted in a fixed relationship with the platform 16, while the other is attached to the platform by a spring-loaded connection. Accordingly, the guide rollers 30 are initially adjusted so that the spring connection of the one guide roller is slightly extended as the workpiece passes between them. It is further understood that during operation of the printing station, and more particularly as the printing cylinder 10 rotates, the guide rollers 30 reciprocate along a lateral, linear path. Indeed, a cam operating in conjunction with the drive mechanism for the printing cylinder 10 causes the gap or space separating the guide rollers 30 to vary in accordance with the rotation of the printing cylinder 10. This reciprocating action is timed in cooperation with the rear pushers 20 so that as the nose of the workpiece is delivered to the guide rollers 30, the guide rollers 30 are positioned in their outermost position. As the workpiece advances, the cam allows guide rollers 30 to close on the workpiece and, thereby, provide proper lateral alignment with the printing cylinder 10. It is appreciated that the reciprocating action and spring loaded tension of guide rollers 30 accommodate minor adjustment and workpiece alignment discrepancies as the workpiece enters the registration point.

In accordance with the foregoing description of the operating environment of a preferred printing station of the lithographic system, a workpiece is controllably delivered to a registration point. At this registration point, the workpiece is captively engaged between opposing guide rollers 30 providing proper lateral alignment, and spring-loaded rear pushers 20 that ensure proper longitudinal alignment. Thereafter, control of the workpiece is assumed by grippers which controllably transport the workpiece through the printing station. It is further appreciated that as the printing cylinder 10 continues to rotate under the control of a drive mechanism, guide rollers 30 continue to reciprocate and carrier lugs 18 and rear pushers 20 repeatedly orbit the path defined by carrier chains (not shown) and conveyor chains 25, the printing station described above will repeat the alignment and printing process in an automated fashion.

Figure 2:
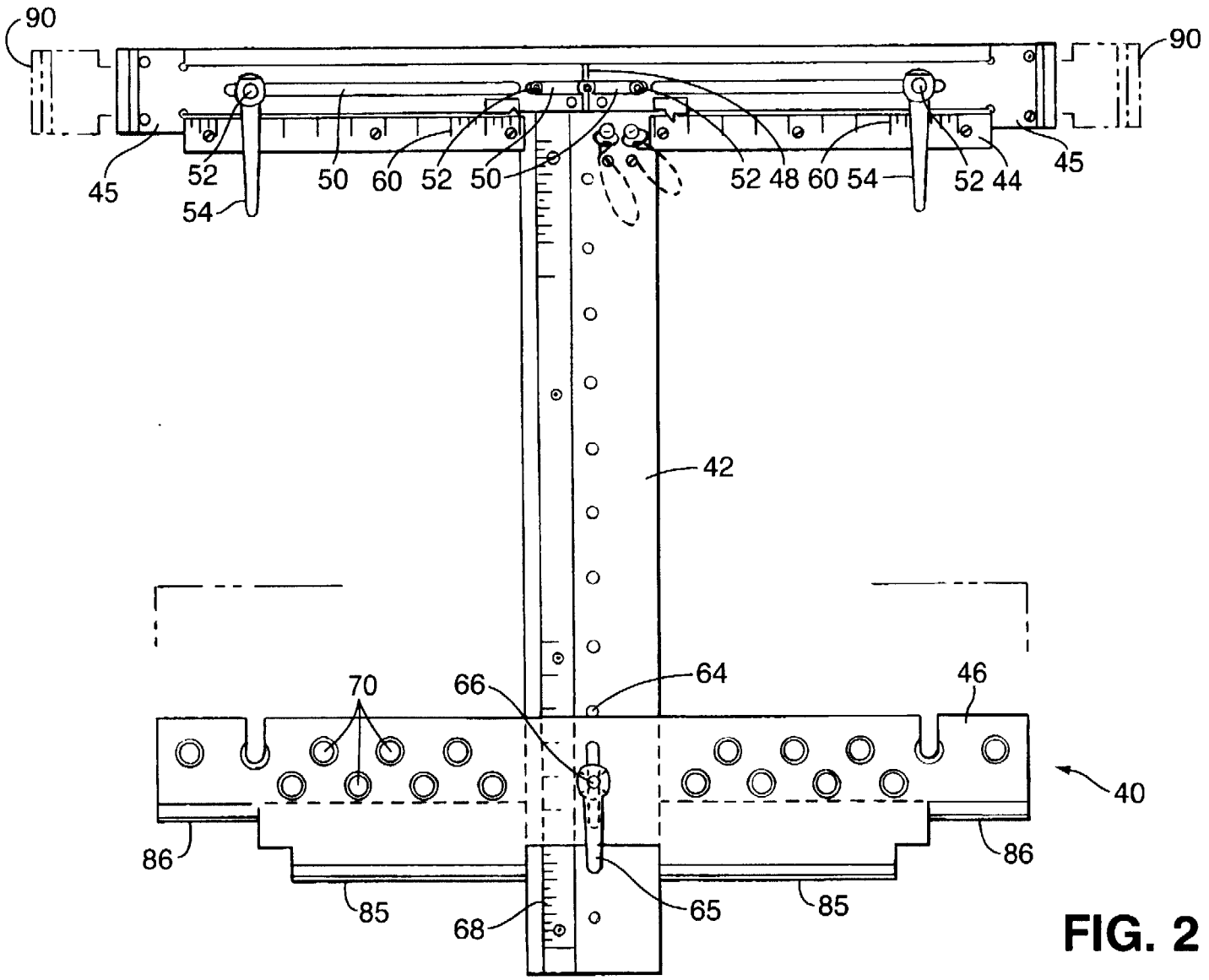
FIG. 2 is a top plan view of the alignment apparatus shown in FIG. 1.

Reference will now be made to FIG. 2 in describing the preferred embodiment of the present invention. More particularly, the present invention is directed to an alignment apparatus 40 (also referred to as a set-up gauge) that is used to facilitate the initial adjustments of rear pushers 20 and guide rollers 30 described in connection with FIG. 1. The alignment apparatus 40 principally comprises an elongated body member 42 and first and second cross-arms 44 and 46. Preferably, the first cross-arm 44 is rigidly attached to body number 42 and split at 48, to form two independently adjustable lateral extensions 45. To be sure, while the outer regions of cross-arm 44 are stationary in relation to body member 42, the inner regions include extensions 45 that slidably attaches to the stationary regions to provide a laterally adjustable extension.

Guide tracks 50 cooperate with posts 52 (also see FIG. 3) form a guide means that define the lateral path of extension. Means for locking are provided by locking levers 54 which are threadedly engaged to cross-arm 44 to loosen and secure lateral extensions 45. As mentioned, extensions 45 are disposed to slidably engage cross-arm 44. When rotated in one direction, locking levers 54 loosen the engagement between extensions 45 and cross-arm 44, and when rotated in the opposing direction, secure the engagement therebetween. A numerical scale 60 is also provided to facilitate precise lateral adjustment of extensions 45.

Cross-arm 46 is slidably attached to body member 42. Guide track 64, lever lock 65, and guide post 66, provide a means of adjustably disposing cross-arm 46 along body member 42 in the same fashion described in connection with cross-arm 44. Similarly, numerical scale 68 is provided to facilitate precise adjustment of cross-arm 46. Preferably, the alignment apparatus 40 is made from a aluminum stock, or other lightweight durable material. Holes 70 are nevertheless provided in cross-arm 46 to further reduce the weight thereof.

It is appreciated that the guide tracks 50 and 64, and the guide posts 52 and 66 combine to form adjusting means for providing both lateral and longitudinal adjusting capabilities. Consistent with the concepts and teachings of the present invention, however, a number of structural variations or adaptations may be employed to achieve this functionality. Accordingly, illustrated structural implementation is not intended to act as a limitation to the broader aspects of the present invention.

Having described the elements of alignment apparatus 40, its proper use and set-up will now be discussed. The initial adjustments are made to the alignment apparatus 40 in the following manner. The workpiece (e.g. sheet metal) is measured to obtain its length and width dimensions. Numbers provided on numerical scale 68 correspond to the length dimension of the workpiece. Therefore, cross-arm 46 is adjusted to align with that particular number, and is then secured in place by lever lock 65. The width dimension, however, is first divided by two. Numerical scales 60 provided on cross-arm 44 are numbered to correspond to the divided width dimension. Accordingly, extensions 45 are manually adjusted so that a set-up mark on the extensions 45 aligns with the particular number on scale 60 equal to one-half the width of the workpiece. Lever locks 54 are then tightened to secure extensions 45 in place. At this point, the alignment apparatus is properly adjusted and ready for installation on platform 16 (see FIG. 1).

Figure 3:
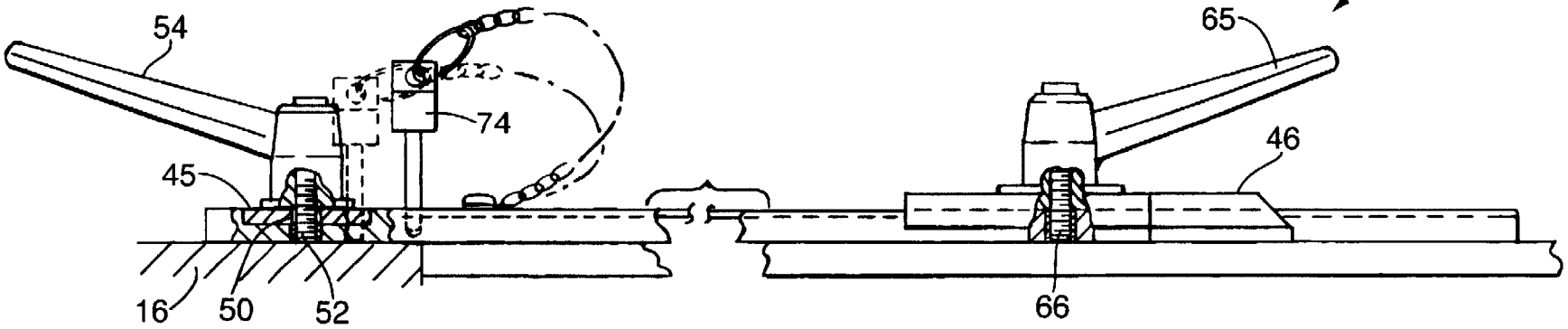
FIG. 3 is a cross-sectional side-view of the alignment apparatus of FIG. 2.

Mounting pins 74 are used to connect alignment apparatus 40 with the press bed or platform 16. More specifically, two anchor holes 78 (See FIG. 3) are provided along the centerline of platform 16. These anchor holes 78 are aligned with pilot holes 80 provided in cross-arm 44 of the alignment apparatus. Mounting pins 74 are then inserted through pilot holes 80 and into platform 16. In this way, the alignment apparatus 40 is readily installed in proper alignment with the printing station, so that adjustments to the guide rollers 30, 18 and rear pushers 20 can now be made. Mounting pins 74 are shown in FIG. 3 in both solid and dashed lines. The solid line representation illustrates the storage position of mounting pins 74. That is, when alignment apparatus 40 is not installed on platform 16 of the printing station, storage holes 82 are provided on the apparatus for convenient storage of mounting pins 74. The dashed line configuration illustrates the position of mounting pins 74 when alignment apparatus 40 is properly installed on platform 16.

The discussion will now be directed to the proper adjustment of guide rollers 30, carrier lugs 18, and rear pushers 20. Initially, the printing station is operated to bring the carrier lugs 18 into close proximity to cross-arm 46 of alignment apparatus 40. At this point, the machine is shut down and the brake is turned off or disengaged, whereby manual rotation of the printing cylinder 10 may be made. In this regard, the drive mechanism is manually advanced to rotate the printing cylinder 10 to a predetermined orientation. From this orientation, the printing plate 14 is disposed to align with the workpiece as the workpiece is advanced by grippers into the printing cylinder 10. A timing light is provided (not shown) to illuminate, and thus alert the operator, when this predetermined orientation is reached. At this time, adjustments may be made to the carrier lugs 18 and rear pushers 20. In this regard, carrier lugs are adjusted to contact surfaces 85 on cross-arm 46 (See FIG. 2), and rear pushers 20 are adjusted to contact surfaces 86. Guide rails 28 may be adjusted by loosening lever lock 88 (See FIG. 1), as previously described, to allow 2 or 3 inches of slack between the workpiece and the guide rails 28. Finally, the lateral disposition of guide rollers 30 is adjusted. Extensions 45 of cross-arm 44 facilitate this adjustment. To be sure, guide rollers 30 are adjusted so as to contact the outer surfaces 90 of extensions 45.

Having made the proper adjustments to the components of the printing station, the alignment apparatus 40 may be removed simply by removing mounting pin 74 and lifting the apparatus from the platform 16. It can be appreciated that the foregoing adjustments are greatly simplified by the use of alignment apparatus 40. Indeed, adjusting the various components of the printing station by merely bringing them into contact with the surfaces 85 and 86 of cross-arm 46 and surfaces 90 of extensions 45 provides a significant time savings by eliminating the need to make critical measurements and adjustments from the platform 16.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for configuring a printing station of a lithographic system to align a workpiece with a printing cylinder of the printing station comprising:

an elongated body member adapted for alignment with a printing cylinder, the body member extending along a path transverse to the axis of the printing cylinder;

a first cross-arm perpendicularly attached to the body member and laterally extending from both sides thereof;

first means associated with the first cross-arm for variably adjusting the lateral extension of both sides of the first cross-arm to facilitate the adjustment of laterally disposed guide rollers of the lithographic system;

a second cross-arm perpendicularly attached to the body member and laterally extending from both sides thereof, the second cross-arm being spaced apart from the first cross-arm; and second means associated with the second cross-arm for variably adjusting the longitudinal spacing separating the first and second cross-arms.

2. The apparatus according to claim 1, further including means for attaching the apparatus to a platform that supports the workpiece, the attaching means disposed to attach the apparatus in a predetermined alignment with the platform and printing cylinder.

3. The apparatus according to claim 2, wherein the attaching means includes a pair of retaining pins and corresponding anchor holes in the platform.

4. The apparatus according to claim 1, wherein the first cross-arm includes two independently adjustable portions, each portion being substantially identical to the other portion.

5. The apparatus according to claim 4, wherein the first means includes a guide track disposed in each portion of the first cross-arm to controllably direct the lateral extension of each portion of the first cross-arm.

6. The apparatus according to claim 5, further having a cross-arm locking means for locking each portion of the cross-arm once each portion has been adjusted to the desired lateral position.

7. The apparatus according to claim 6, wherein the cross-arm locking means includes a locking lever associated with each cross-arm portion, each locking lever being adapted for movement between a locked position and a adjustment position, wherein when the locking lever is in the adjustment position the cross-arm portion is freely movable along the guide track for lateral adjustment, and when the locking lever is in the locked position the cross-arm portion is secured in its present position.

8. The apparatus according to claim 7, wherein each cross-arm portion includes a numerical scale to facilitate measured adjustment of the cross-arm.

9. The apparatus according to claim 1, wherein the first cross-arm includes a numerical scale to facilitate measured adjustment of the cross-arm.

10. The apparatus according to claim 1, wherein the second cross-arm is slidably connected to the body member.

11. The apparatus according to claim 10, wherein the second means includes a guide track disposed in the body member to controllably direct the longitudinal disposition of the second cross-arm.

12. The apparatus according to claim 11, further having a cross-arm locking means for locking the second cross-arm in place once the second cross-arm has been adjusted to the desired position along the body member.

13. The apparatus according to claim 12, wherein the cross-arm locking means includes a locking lever adapted for movement between a locked position and an adjustment position, wherein when the locking lever is in the adjustment position the second cross-arm is freely movable along the guide track for longitudinal adjustment along the body member, and when the locking lever is in the locked position the second cross-arm is secured in its present position.

14. The apparatus according to claim 13, wherein the body member includes a numerical scale to facilitate measured adjustment of the second cross-arm.

15. An alignment apparatus for use in a lithographic system comprising:

an elongated body member; a first arm and a second arm, the arms being spaced apart and perpendicularly attached to the body member; means for variably adjusting the lateral extension of the first arm; and means for variably adjusting the longitudinal spacing separating the arms wherein the first arm includes two substantially identical half portions, each half portion being symmetrically disposed on either side of the body member.

16. The alignment apparatus according to claim 15, wherein the two half portions are independently adjustable.

17. The alignment apparatus according to claim 16, wherein each half portion includes a guide track disposed to controllably direct the lateral extension of each portion.

18. The alignment apparatus according to claim 17, further including a locking means for locking each half portion of the first arm in place.

19. The alignment apparatus according to claim 18, further including a guide track disposed in the body member to controllably direct the longitudinal disposition of the second arm.

20. The alignment apparatus according to claim 19, further including a locking means for locking the second arm in place along the body member.

21. The alignment apparatus according to claim 15, wherein at least one of the two half portions are independently adjustable.

22. The alignment apparatus according to claim 15, wherein both half portions are independently adjustable.

* * * * *